US006590489B1

(12) United States Patent
Ullermann et al.

(10) Patent No.: US 6,590,489 B1
(45) Date of Patent: Jul. 8, 2003

(54) CIRCUIT BREAKER FOR PROTECTING ELECTRIC CIRCUITS IN ROAD VEHICLES

(75) Inventors: Wolfgang Ullermann, Schwabach (DE); Ludwig Seiverth, Altdorf (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 0 days.

(21) Appl. No.: 09/857,806

(22) PCT Filed: Nov. 5, 1999

(86) PCT No.: PCT/EP99/08501

§ 371 (c)(1),
(2), (4) Date: Jun. 11, 2001

(87) PCT Pub. No.: WO00/34971

PCT Pub. Date: Jun. 15, 2000

(30) Foreign Application Priority Data

Dec. 9, 1998 (DE) ..... 198 56 707

(51) Int. Cl.[7] ..... H01H 71/16; H01H 71/50

(52) U.S. Cl. ..... 337/56; 337/53; 337/91; 337/89; 337/112

(58) Field of Search ..... 337/3, 13, 36–38, 337/41, 53, 56, 62, 63, 66, 68, 72, 76, 85, 86, 91, 111, 112, 158, 333, 348, 357–359; 200/310–316, 520–540

(56) References Cited

U.S. PATENT DOCUMENTS

| | | | | | |
|---|---|---|---|---|---|
| 4,363,016 | A | * | 12/1982 | Unger | 337/56 |
| 4,570,142 | A | * | 2/1986 | Ineichen et al. | 337/66 |
| 4,573,031 | A | * | 2/1986 | Krasser | 337/66 |
| 4,667,175 | A | * | 5/1987 | Sell | 337/347 |
| 4,682,138 | A | * | 7/1987 | Sell | 337/66 |
| 4,764,746 | A | * | 8/1988 | Nakano et al. | 337/66 |
| 4,814,738 | A | * | 3/1989 | Krasser et al. | 337/66 |
| 4,814,739 | A | * | 3/1989 | Moldovan | 337/66 |
| 4,990,882 | A | * | 2/1991 | Peter | 337/57 |
| 5,742,219 | A | * | 4/1998 | Moalem et al. | 337/37 |
| 5,854,585 | A | * | 12/1998 | Kingma | 337/343 |
| 5,861,794 | A | * | 1/1999 | Pellon | 337/348 |
| 5,918,361 | A | * | 7/1999 | Moalem et al. | 200/506 |

FOREIGN PATENT DOCUMENTS

| | | | | |
|---|---|---|---|---|
| CH | 647094 A5 | * | 12/1984 | H01H/71/16 |
| DE | 1 091 205 | | 10/1960 | |
| DE | 1 099 624 | | 2/1961 | |
| DE | 1 805 368 | | 5/1969 | |
| DE | 3526785 | | 7/1986 | |
| FR | 998730 | | 1/1952 | |

* cited by examiner

*Primary Examiner*—Anatoly Vortman
(74) *Attorney, Agent, or Firm*—Venable LLP; Robert Kinberg; Jung (John) Kim

(57) ABSTRACT

A circuit breaker for protecting electrical circuits, particularly in motor vehicles, includes a flat housing, which comprises an insulating material and has two adjacent flat plugs. A bimetal that is embodied as a snap-action element and is fixed to a flat plug serves in contacting the flat plugs together, with the contact end of the bimetal being located in an overlapping position with the counter-contact. During a contact opening as stipulated by an overcurrent, a contact separator automatically travels into the space between the opened contacts, and can be returned from its contact-separating position by the external exertion of a force acting counter to the spring pressure. A manual release device, which diverts the contact end of the bimetal from its contacting position into its contact-opening position, protrudes from the breaker housing.

14 Claims, 4 Drawing Sheets

CIRCUIT BREAKER FOR PROTECTING ELECTRIC CIRCUITS IN ROAD VEHICLES

BACKGROUND OF THE INVENTION

The invention relates to a circuit breaker for protecting electrical circuits in road vehicles, having a flat, substantially parallelepiped housing, which comprises an insulating material, for a space-saving juxtaposed arrangement. The housing has two substantially parallel top surfaces, in which flat plugs for contacting with a flat-fuse holder protrude out of a housing side wall of the housing. The plugs have flat planes oriented parallel to the two top housing surfaces. The housing side wall penetrated by the flat plugs is formed by a base part that supports the flat plugs, whereas other housing walls of the housing are components of a housing cover that is pushed onto the base part, and enclose functional parts of the breaker. The flat plugs have housing-side ends adjacent to one another that protrude into the housing interior and makes a contact to one another via a bimetal snap disk that is fixed to one of the flat plugs and opens the contact in the event of an overcurrent. The housing cover has a housing opening, which is located in a housing side wall opposite the base part in the assembled state, for a manual release device that lifts the bimetal snap disk out of a position making the contact. The house opening surrounds a bearing shaft for the manual release device, the shaft extending transversely to a passage direction of the manual release device and parallel to the plane of extension of the bimetal snap disk, and being integrally formed onto the housing cover. The manual release device is snapped externally onto the bearing shaft such that, in the snapped-on position, the manual release device acts as a two-armed lever, extending beneath the bimetal snap disk with a release arm that protrudes into the housing interior for selectively acting upon the disk in a contact-opening direction, and protrudes with an actuating arm beyond the housing side wall opposite the base part. These circuit breakers are intended to be used worldwide in motor vehicles equipped with flat fuse sockets, in place of the conventional cut-out fuses according to DIN 72581-3.

It is the object of the invention to permit a simpler method than methods disclosed in DE-A-1099624 for breaking the circuit protected by the automatic circuit breaker arbitrarily, without an overcurrent release, in a circuit breaker of the type mentioned at the outset. For simple, manual circuit breaking, especially in the intended purpose of protecting the electrical circuits of motor vehicles, it is necessary to effectively prevent battery drainage due to creeping currents, e.g., if the vehicle is not used for an extended period of time. This is often the case, for example, from the time of the final inspection of the vehicle until it is delivered to the buyer. In the interim, the vehicle is often transported or stored over long periods.

The manual release device can be designated as a two-armed pivot lever whose release arm is in the inoperative position on the contact side of the bimetal snap disk. In the contact position of the bimetal snap disk, the release arm does not touch the bimetal. Rather, it is held, contactless, in this initial and inoperative position by a spring pressure that is exerted by the bearing shaft of the manual release device onto the lower leg of the release device, as a pivot drive. The special structural feature is that the manual release device acting as a two-armed pivot lever is snapped to the bearing shaft, which is embodied in one piece with the housing cover, by a movable snap connection. This construction is adapted to narrow space conditions, is simple in terms of assembly, and can be realized at a low cost. Finally, a circuit breaker in accordance with the invention can-be mass-produced. The manual release device is lightweight and operates reliably, even under the notoriously narrow conditions of numerous circuit breakers arranged in adjacent rows. When the circuit breaker according to an embodiment of the present invention includes an additional contact separator, it is unequivocally apparent whether a release motion of the release device has effected the desire contact separation: the pressing end of the contact separator protrudes from the breaker housing after the separator is manually released. The actuating arm of the manual release device that protrudes from the housing prevents the contact separator from returning due to pressure exerted on its pressing end, as well as the automatic snap contacting or reclosure of the circuit breaker that may occur afterward, when the bimetal has cooled. Therefore, the subject of the invention can easily be implemented, even in an otherwise unchanged construction of the prior art cited at the outset.

BRIEF DESCRIPTION OF DRAWINGS

An embodiment of the invention is explained in conjunction with the figures. Shown are in.

DETAILED DESCRIPTION OF INVENTION

Figure 1:
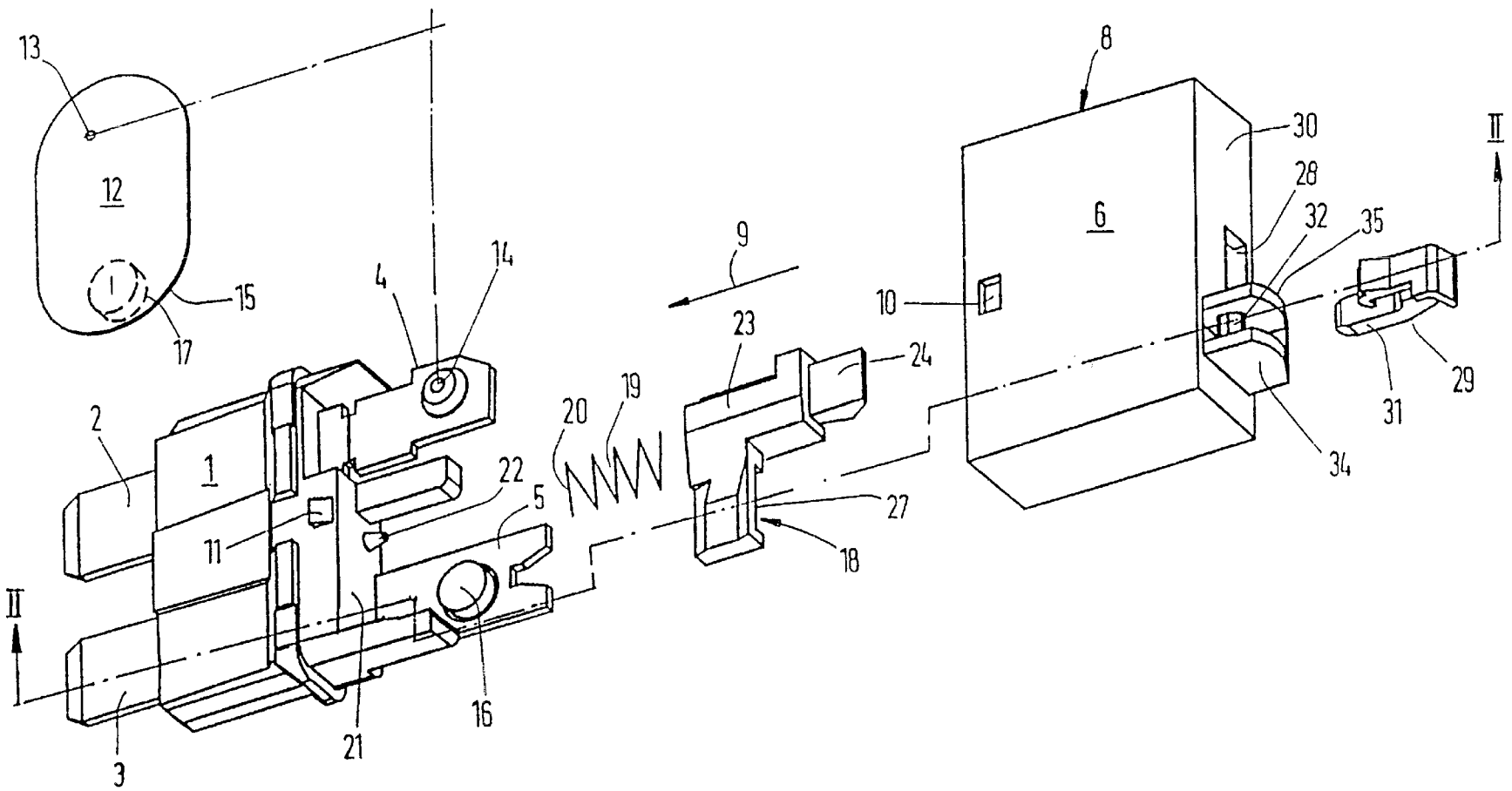
FIG. 1 a perspective, exploded view of the individual parts of the circuit breaker.

The underlying principle of the circuit breaker is similar to those disclosed in EP 0 151 692 B1, and its improved version, DE 35 26 785 C1. The subject of present application builds on these constructions by adding the option of an external manual release device, without imposing significant structural changes on the breaker. This is an important point because, should there be any confusion with regard to the following descriptions of the figures, the contents of these documents can or should serve as references.

In the overcurrent circuit breaker, the base part 1, which comprises an insulating material, is injected around the two parallel flat plugs 2, 3. This secures the flat plugs 2, 3 to the housing. The plug ends of the flat plugs 2, 3 protrude from the base part 1. Their ends 4, 5 protrude into the interior of the circuit-breaker housing. The flat plugs 3, 4 extend over their entire length as known flat-fuse inserts that act as cut-out fuses, in accordance with the guidelines of known DIN Standard 72581-3. The flat plugs 3, 4 extend essentially parallel to the plane of the top housing surfaces 6, 7 of the housing cover 8 that can be pushed in the longitudinal direction 9 onto the base part 1. In the pushed-on or assembled position, the housing cover 8 is snapped to the base part 1. Here, the fixing opening 10 in the top housing surface 6 snaps onto the fixing tooth 11 of the base part 1.

The flat plugs 2, 3 have a flat-rectangle cross-sectional shape over their entire length. On the inside end 4 of the flat plug 2, the bimetal snap disk 12 is secured, e.g., welded, by its fixing end 13 to the fixing point 14. The movable end 15 of the bimetal snap disk 12 protrudes, as a contact end, into an overlapping position with the inside end 5 of the other flat plug 3. On its top side, this inside end 5 supports the stationary counter-contact 16 for the movable contact 17 fixed to the underside of the movable end 15 of the bimetal snap disk 12.

Figure 2:
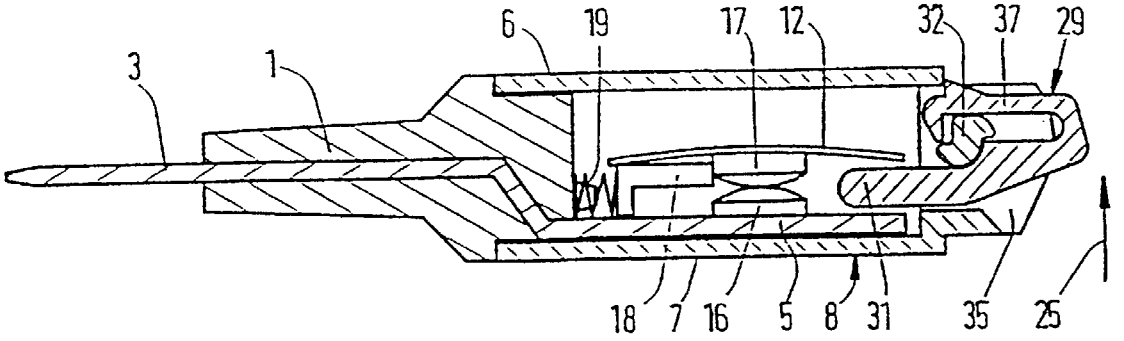
FIG. 2 a longitudinal section, along the line II—II in FIG. 1, through the assembled switch, in the contact position of the bimetal.
Figure 5:
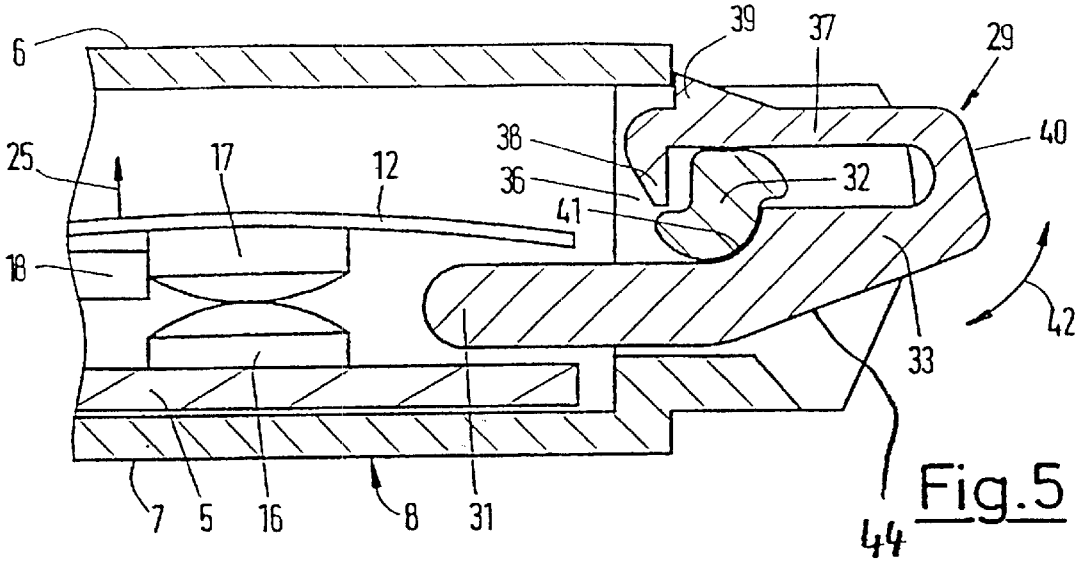
FIGS. 5–7 enlarged, cutout representations of the contact and manual-release regions of the breaker according to FIGS. 2–4.
Figure 6:
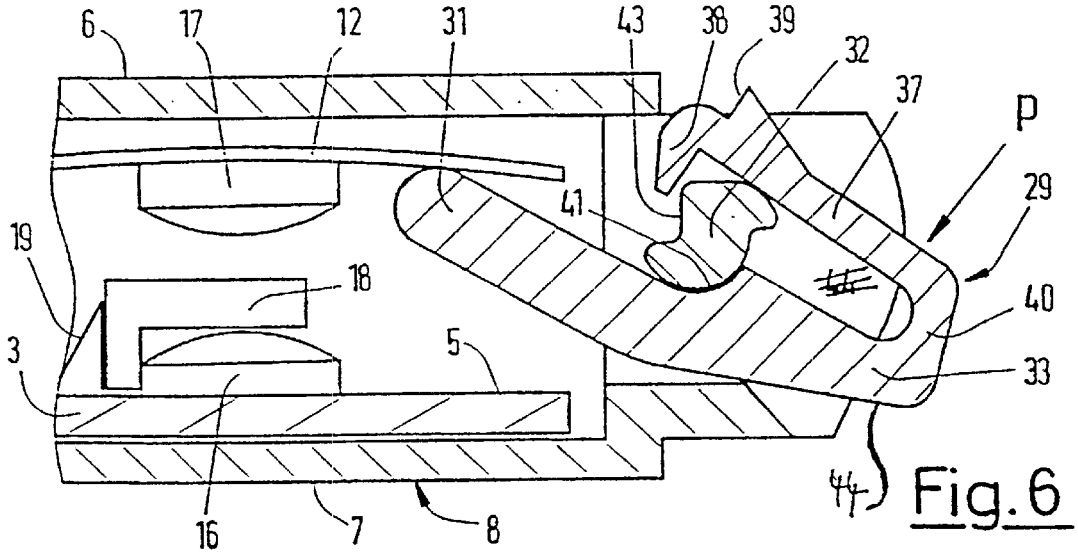

When the bimetal snap disk 12 is cold, the movable contact 17 fixed to its movable end 15 contacts the counter-contact 16 of the flat plug 3. This closes the current path between the two flat plugs 2 and 3. FIGS. 2 and 5 illustrate this closed position, in which a contact separator 18 rests against the flank of the movable contact 17 facing the base part 1. The tensed compression spring 19 presses the separator against the flank of the movable contact 17, in the pressing direction counter to the longitudinal direction 9. The compression spring 19 is supported with its rear end 20 against the base 1. Mounted to the support surface 21 of the base is a centering mandrel 22 for securing the position of the compression spring 20, which is embodied as a helical spring, inside the breaker housing.

The contact separator 18 constitutes one of the legs of a structure that forms a right angle in the plan view (FIG. 1), and whose other leg 23, which protrudes counter to the longitudinal direction 9, supports the pressing end 24 of the contact separator 18, which lies between the inside ends 4, 5 of the flat plugs 2, 3, and is therefore oriented parallel to the inside ends 4, 5 of the flat plugs 2, 3 positioned on both sides, when the contacts 16, 17 are in the contacting position (FIGS. 2, 5) and the compression spring 19 is correspondingly compressed inside the housing cover 8.

Figure 3:
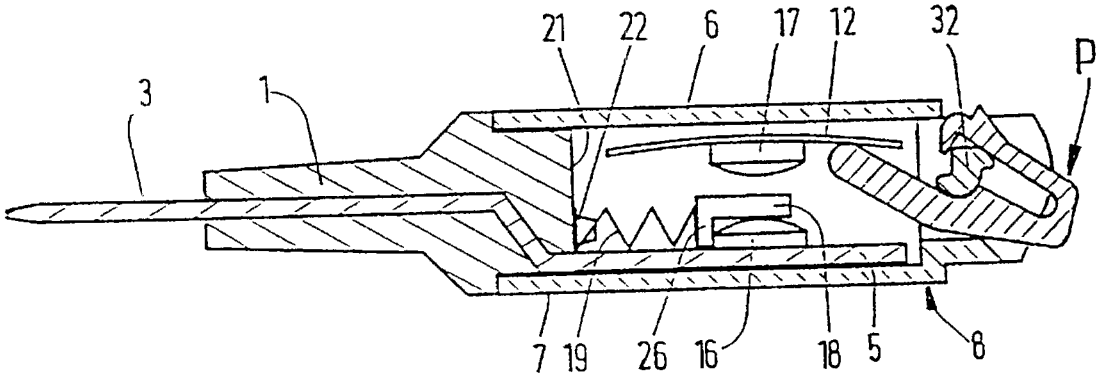
FIG. 3 a representation analogous to FIG. 2, with the manual release device being pivoted out to its maximum release position and, accordingly, an opened breaker.
Figure 4:
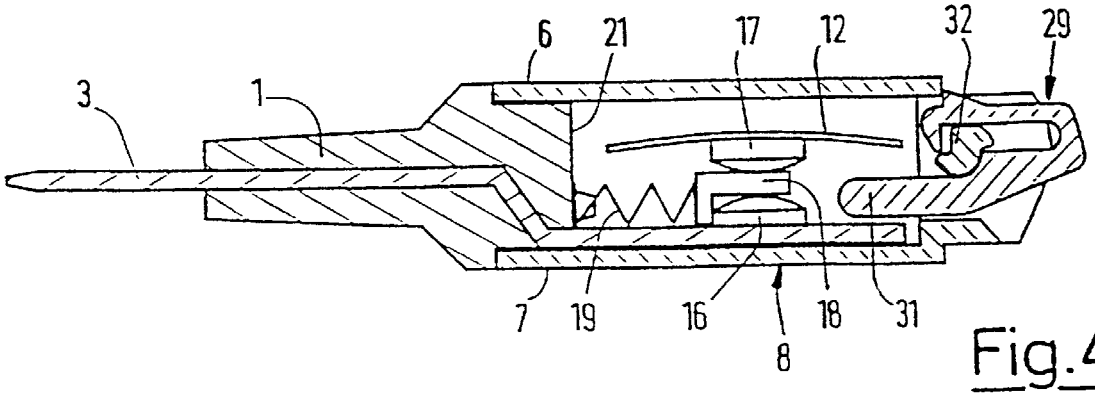
FIG. 4 the breaker in the release position in accordance with FIG. 3, with the released manual release device.

When the contacts 16, 17 have been separated in the contact-opening direction, the movable contact 17 is not only lifted from the counter-contact 16, but the contact of the contact separator 18 at its flank facing the base 1 is also broken (FIGS. 3, 4; 6, 7). This releases the compressed spring 19, which pushes the contact separator 18 in the direction counter to the longitudinal direction 9 and into a covering position, in which it shields the fixed contact or counter-contact 16 from the movable contact 17 connected to the bimetal 12. In this covering position, the stop 26 protruding from the underside of the contact separator 18 impacts the flank of the counter-contact 16 facing it. This stop limits the separating movement of the contact separator 18, and positions the contact separator 18 to shield the counter-contact 16. The compression spring 19 continues to exert a permanent pressure on the contact separator 18, counter to the longitudinal direction 9. In the illustrated longitudinal displacement effected by the expanded compression spring 19, the contact separator 18 is guided as if on a rail on the top surface of the bare, inside end 5 of the flat plug 3 extending in the housing. A guide recess 27 that acts in the manner of a track groove is provided on the underside of the contact separator 18 for this purpose (FIG. 1).

In the separated position of the two contacts 16, 17 (FIGS. 3, 4; 6, 7), the pressing end 24 of the pressing leg 23 of the contact separator 18 protrudes through the opening 28 of the housing cover 8, thereby signaling a complete contact opening. A signal color of the pressing end 24, which is distinguishable from the housing color, can assure or improve the external recognition of this signal.

To this point, the described function of the overcurrent circuit breaker has been identical to that of the prior art described at the outset, in which the contact opening 16, 17 is initiated by a bimetal release, that is, heating of the bimetal snap disk 12.

In accordance with the invention, a manual release device is provided in addition to the bimetal snap release. For this purpose, a manual release device 29 that selectively raises the bimetal snap disk 12 from its contacting position (FIGS. 2, 5) is provided. This device is embodied as a two-armed lever whose actuating end protrudes out of the flat side 30 of the housing cover 8 that faces away from the flat plugs 2, 3. The manual release device 29 is positioned next to the leg 23 or the pressing end 24 of the contact separator 18, on the side facing the inside end 5 of the flat plug 3, and extends with its longitudinal direction 9 parallel to the leg 23.

For the contact opening, the manual release device 29 moves the contact end 15 of the bimetal snap disk 12 from its contact side that supports the movable contact 17 in the contact-opening direction 25. The release arm 31 of the manual release device 29 embodied as a two-armed pivot lever effects this motion as it is pivoted upward about the bearing shaft 32 embodied in one piece with the housing cover 8.

The other arm, namely the actuating arm 33 of the manual release device 29, protrudes beyond the bearing shaft 32. The entire length of the actuating arm 33 is located outside of the housing cover 8. This is also basically the case for the bearing shaft 32. It is positioned between the two holding cheeks 34, 35, which simultaneously assure the longitudinal guidance or orientation of the manual release device 29, and form an integral component of the housing cover 8 and the bearing shaft 32. On the outside, the bearing shaft 32 is positioned in front of the housing opening 36, through which the manual release device 29 protrudes into the housing interior.

The manual release device 29 is a one-piece, approximately U-shaped component that comprises an insulating material, and whose two U-legs extend around the bearing shaft 32. The one U-leg, namely the lower one in the figures, is formed by the actuating arm 33 and the release arm 31 protruding into the housing interior. The bearing shaft 32 of the manual release device 29 is oriented approximately parallel to the bimetal snap disk 12 and the top housing surfaces 6, 7. It extends perpendicular to the drawing planes of FIGS. 2 through 7.

The U-leg of the manual release device 29 that is positioned, as a fixing leg 37, above the bearing shaft 32 is provided with a retaining latch 38 that extends behind the bearing shaft 32 and protrudes in the direction of the release leg 31.

Furthermore, the fixing leg 37 has on its top side a protruding housing stop 39, which limits the insertion length of the manual release device 29 vis-à-vis the housing opening 36, and can be seen in its stopped position at the top housing surface 6 in FIGS. 2, 5. The crosshead 40 of the U-shape forms the actuating arm 33 of the manual release device 29.

The inside flank of the lower U-leg, namely the release arm 31 of the manual release device 29, is hollowed out in approximately the central region of its longitudinal extension to form the bearing shell 41.

The manual release device 29 is snapped onto the bearing shaft 32 by a movable snap connection. To this end, its two U-legs resiliently extend as integrated snap elements, and/or as counter-surfaces cooperating with the snap elements, around the bearing shaft 32. When the manual release device 29 experiences a releasing pivoting movement 42, the U-legs of the manual release device 29 has an elastically spreading cross-sectional shape, so the elastic spring pressure accumulated by the spreading action is effective as the restoring pressure that automatically pivots the manual release device 29 into its initial pivoting position, counter to the release pivoting 42. This cross-sectional shape is characterized by a certain asymmetry, specifically the fact that the cross-sectional dimension of the bearing shaft 32 that acts upon the U-legs 31, 37 in the release pivoting position (FIGS. 3, 6) is larger than the cross-sectional dimension that acts upon the U-legs 31, 37 in the inoperative position (FIGS. 2, 4, 5, 7, 8) of the manual release device. This asymmetry also creates a counter-stop surface for the retaining latch 38 and a pivot stop 44 for the actuating arm 33 for limiting the pivoting range of the manual release device 29.

Figure 7:
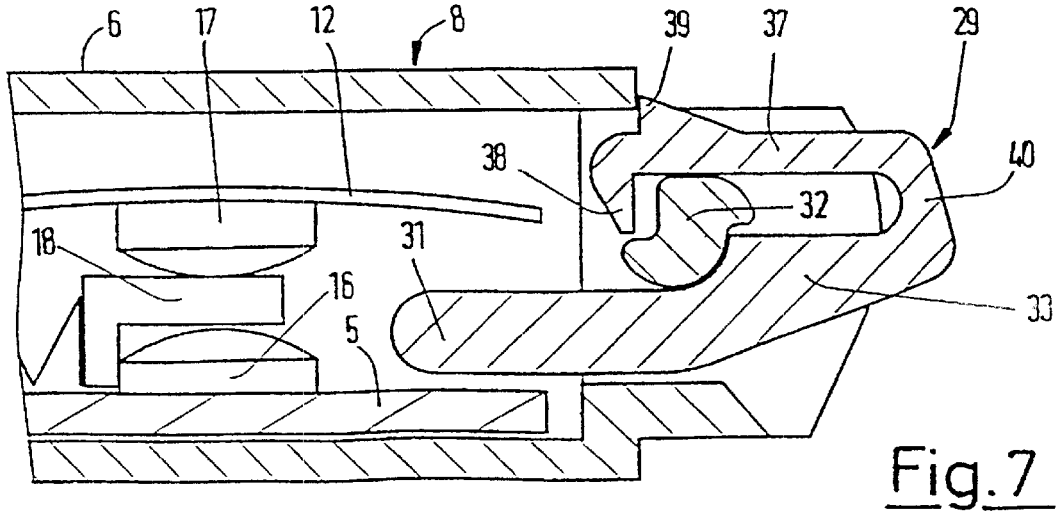

The U-shape and the resilient consistency of the manual release device 29, as well as the cross-sectional shape of the bearing shaft 32, which deviates from a circle and more closely approximates an ellipse, are advantageous for numerous reasons. Regardless of the cross-sectional shape of the bearing shaft 32, the manual release device 29 is simply and securely snapped onto the bearing shaft 32. The U-leg ends of the manual release device 29 that lie in the housing opening 36 are merely pushed on from the outside and snapped in place. FIGS. 5 and 7 illustrate the pushed-on or inoperative position. Here, the release arm 31 of the manual release device 29 is located beneath the bimetal 12. If the manual release device 29 is rotated clockwise about the bearing shaft 32, the release end 31 is raised. It extends beneath the bimetal snap disk 12 and raises it into a position that lifts the contact 17 from the counter-contact 16. This breaks the contact of the contact separator 18 with the movable contact 17, and the contact separator travels into its covering position (FIGS. 3, 6) under the pressure of the compression spring 19, which prevents a reclosure, that is, a return of the bimetal 12 or the movable contact 17 connected thereto into its contacting position. If the clockwise pivoting pressure P (FIGS. 3, 6) exerted externally onto the actuating arm 33 of the manual release device ceases, the manual release lever 29 is released, and pivots counterclockwise back into the initial position shown in FIGS. 4 and 7 due to the accumulated spreading pressure acting between the two U-legs and exerted by the bearing shaft. In this initial position, the release arm 31 maintains a clear distance from both the bimetal 12 and the inside end 5 of the flat plug 3.

Figure 8:
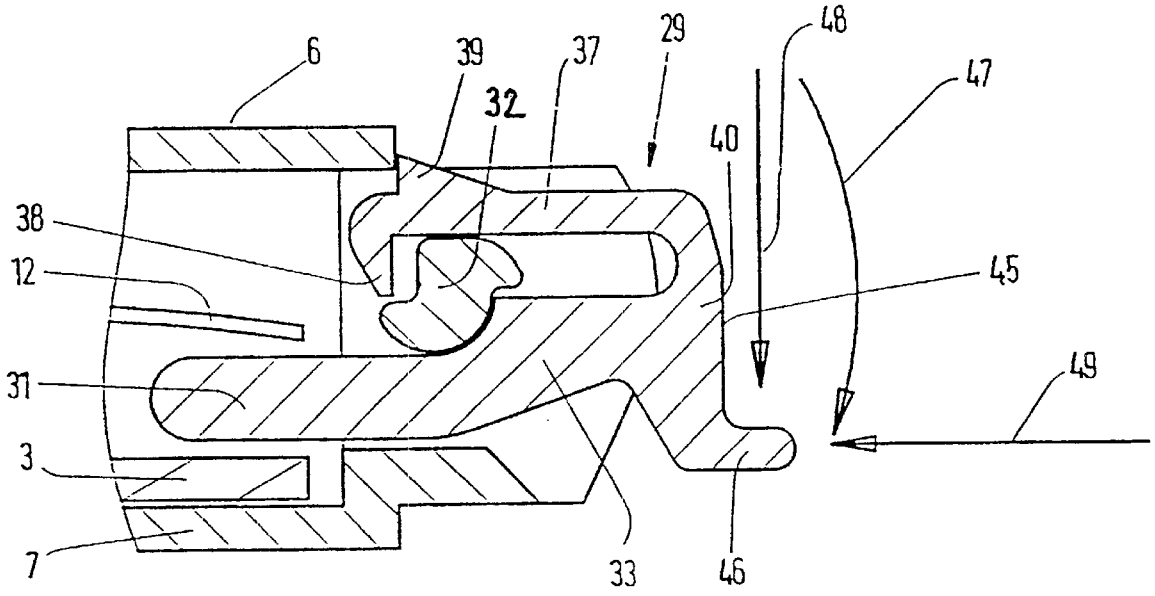
FIG. 8 a modified embodiment of the manual release device 29.

FIG. 8 shows a modified embodiment of the manual release device 29. The modification concerns the arrangement of an actuating tail 46, which protrudes beyond the head surface 45 of the crosshead 40 of the manual release device 29. The actuating tail 46 protrudes in the direction counter to the longitudinal extension of the release arm 31, and is positioned at the point of intersection of the longitudinal directions of the crosshead 40 and the release arm 31 or actuating arm 33. A critical point is that the arrangement is shifted off-center relative to the bearing shaft 32, both in the horizontal and vertical planes (FIG. 8), such that nearly every pressure effect exerted on the actuating tail generates a force component, independently of the direction of the pressure, that is converted into a pivoting movement of the manual release device 29 that releases the circuit breaker. The directional arrow 47 indicates the pivoting direction 47, or the torque resulting therefrom. Directional arrows also indicate the directions of movement 48, 49 that lead to such a torque effect.

Moreover, the manual release device 29 is provided with a color that clearly contrasts with that of the housing, and is selected analogously to the safety colors in accordance with DIN 72581-3, which even facilitates a reliable selection and manual actuation in a multiple-row arrangement.

What is claimed is:

1. A circuit breaker for protecting the electrical circuits of motor vehicles, having a flat, substantially parallelepiped housing, which comprises an insulating material, for a space-saving juxtaposed arrangement, the housing having two substantially parallel top surfaces, in which flat plugs for contacting with a flat-fuse holder protrude out of a housing side wall of the housing, the plugs having flat planes oriented parallel to the two top housing surfaces;

in which the housing side wall penetrated by the flat plugs is formed by a base part that supports the flat plugs, whereas other housing walls of the housing are components of a housing cover that is pushed onto the base part, and enclose functional parts of the breaker; and in which the flat plugs have housing-side ends adjacent to one another that protrude into the housing interior and makes a contact to one another via a bimetal snap disk that is fixed to one of the flat plugs and opens the contact in the event of an overcurrent, wherein the housing cover has a housing opening, which is located in a housing side wall opposite the base part in the assembled state, for a manual release device that lifts the bimetal snap disk out of a position making the contact;

the house opening surrounds a bearing shaft for the manual release device, the shaft extending transversely to a passage direction of the manual release device and parallel to the plane of extension of the bimetal snap disk, and being integrally formed onto the housing cover; and the manual release device is snapped externally onto the bearing shaft such that, in the snapped-on position, the manual release device acts as a two-armed lever, extending beneath the bimetal snap disk with a release arm that protrudes into the housing interior for selectively acting upon the disk in a contact-opening direction, and protrudes with an actuating arm beyond the housing side wall opposite the base part.

2. The circuit breaker according to claim 1, wherein a contact separator, which is disposed inside the housing and moves between a contact of one of the flat plugs and a contact of the disk due to a spring pressure, and spaces the contacts from one another; and the separator returns from a; separating position between the contacts, counter to the spring pressure, by a pressing end that protrudes out of the same housing side as the manual release device, next to the housing opening for the manual release device.

3. The circuit breaker according to claim 1, wherein the manual release device is a one-piece, approximately U-shaped insulating part having two U-legs surround the bearing shaft to form a frictional lockup, where one of the U-legs extends beneath the bimetal snap disk and forms the release arm.

4. The circuit breaker according to claim 3, wherein the other U-leg of the manual release device is provided with a retaining latch that extends, as a fixing leg, behind the bearing shaft in the assembled state and protrudes in the direction of the release arm.

5. The circuit breaker according to claim 4, characterized by a protruding housing stop that limits the insertion length of the manual release device into the housing.

6. The circuit breaker according to claim 3, characterized in that a crosshead of the U-shape forms an outside actuating end of the actuating arm of the manual release device.

7. The circuit breaker according to claim 6, wherein an inside of the U-leg that forms the release arm of the manual release device is hollowed out in approximately the center region of its longitudinal extension to form a bearing shell for the bearing shaft.

8. The circuit breaker according to claim 3, wherein the two U-legs of the manual release device slightly resiliently surround the bearing shaft, as integrated snap elements.

9. The circuit breaker according to claim 3, wherein a cross-sectional shape of the U-legs of the manual release device spreads elastically during a release pivoting movement of the manual release device such that a spring pressure accumulated by a spreading action is effective as a restoring pressure that automatically returns the manual release device into its initial position.

10. The circuit breaker according to claim 9, wherein the cross-sectional dimension of the bearing shaft that acts upon the U-legs in a release pivoting position is larger than the cross-sectional dimension that acts upon the U-legs in the initial position of the manual release device.

11. The circuit breaker according to claim 9, wherein the manual release device is a one-piece, plastic injected piece.

12. The circuit breaker according to claim 6, wherein an outside of the manual release device supports a protruding actuating tail, which, relative to the bearing shaft, is positioned off-center, approximately in the region of an intersection of a longitudinal direction of the crosshead and a longitudinal direction of the release arm or the actuating arm.

13. The circuit breaker according to claim 12, wherein the actuating tail protrudes from the crosshead in the direction counter to the longitudinal direction of the release arm or the actuating arm.

14. The circuit breaker according to claim 1, where a color marking of the manual release device contrasts with the housing and varies in accordance with current intensities of respective electrical circuits to be protected.

* * * * *